US008919438B2

(12) United States Patent
Ramakrishnan et al.

(10) Patent No.: US 8,919,438 B2
(45) Date of Patent: Dec. 30, 2014

(54) DETECTION AND QUANTIFICATION OF ISOLATION DEFECTS IN CEMENT

(75) Inventors: Terizhandur S. Ramakrishnan, Boxborough, MA (US); Nikita Chugunov, Arlington, MA (US); Ram Sunder Kalyanaraman, Vaucresson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 498 days.

(21) Appl. No.: 13/277,868

(22) Filed: Oct. 20, 2011

(65) Prior Publication Data

US 2013/0098604 A1 Apr. 25, 2013

(51) Int. Cl.
*E21B 47/00* (2012.01)
*E21B 49/06* (2006.01)

(52) U.S. Cl.
CPC ..... *E21B 47/0005* (2013.01); *E21B 49/06* (2013.01)
USPC ..... 166/250.01; 166/100; 166/250.02; 166/319

(58) Field of Classification Search
CPC ..... E21B 47/00; E21B 34/00; E21B 47/0005; E21B 49/06
USPC ..... 166/100, 250.01, 250.02, 319; 73/152.05, 152.27
See application file for complete search history.

(56) References Cited

U.S. PATENT DOCUMENTS 7,753,117 B2 7/2010 Ramakrishnan et al.
7,753,118 B2 * 7/2010 Ramakrishnan et al. 166/250.02
2009/0218094 A1 9/2009 McLeod et al.

FOREIGN PATENT DOCUMENTS

WO 2009006524 A2 1/2009
WO 2009067786 A1 6/2009

OTHER PUBLICATIONS

International Search Report and Written Opinion dated Feb. 1, 2013 and issued in International Application No. PCT/US2012/058421 filed Oct. 2, 2012 (11 pages).
Guillot et al. Well Cementing, 2nd Edition. Schlumberger, Houston, TX (2006) pp. 278-288 and pp. 292-299.
Supp et al. Testing of wellbore isolating cements with CO2. Fifth annual NETL (US DOE) conference on Carbon Sequestration, 2006 (1 page).

* cited by examiner

*Primary Examiner* — Yong-Suk (Philip) Ro
(74) *Attorney, Agent, or Firm* — Jakub M. Michna

(57) ABSTRACT

A method for evaluating wellbore integrity including introducing a drill to a surface of a casing encompassing an annulus, enclosing the drill in a housing hydraulically isolating the surface, drilling through the casing and into cement surrounding the casing, observing a pressure of the fluid, and using the pressure observation and a drill position to evaluate a presence of a defect and a location of the defect. Apparatus for evaluating wellbore integrity including a probe comprising a drill, wherein the probe is hydraulically isolated from the wellbore, a valve that encompasses the drill, a pressure gauge to measure the pressure of the fluid within the housing, a pressure gauge to measure the pressure in the system outside the housing, and equipment to compare the pressure measurements and the position of the drill and to evaluate a presence and a location of the defect.

26 Claims, 4 Drawing Sheets

DETECTION AND QUANTIFICATION OF ISOLATION DEFECTS IN CEMENT

FIELD

This application relates to methods and apparatus to identify and estimate wellbore isolation characteristics, specifically defects in annular cement between the casing and the formation.

BACKGROUND

Well-bore zonal isolation is a very important requirement for both geological storage of $CO_2$, and oil and gas production. It is a prerequisite for efficient and safe operation. Presence of micro-annuli, isolation defects or poor quality cementing facilitates hydraulic communication, thus allowing fluid migration, and pose a safety and contamination risk. Lack of proper isolation leads to costly treatment facilities, well intervention and operational interruptions. Isolation is achieved by pumping cement through the annulus between the casing and the formation.

In $CO_2$ sequestration and oil and gas wells, estimating the quality of the annular isolation and repairing the cement where necessary is important for preventing potential leaks and fluid contamination. The presence of a mudcake adjacent to the formation and the lack of slip at the walls may lead to unfilled annuli during cementing. Cracks and micro-annuli may also form during setting and shrinkage, and radial cracks may be initiated due to expansion of the casing during pressurization. Such imperfections in cement facilitate interzonal migration. Additionally chemical alteration of cement is also complex and depends on thermodynamics, kinetics and diffusion of reactive species leading to reaction fronts. Both mechanical and chemical processes can cause radial and azimuthal variations in the cement properties. The ability to detect the presence of micro-annuli or isolation defects and where possible, quantitatively estimate cement transmissibility is crucial for ensuring project safety.

The quality of cement in the annulus is traditionally evaluated by ultrasonic measurements. These measurements, however, provide only qualitative evaluation of hydraulic isolation and are not suitable for volumetric estimation of subtle cement defects or cement transmissibility.

Other work has focused on techniques to quantify cement permeability in the annulus. These methods are based on the relationship between the observed pressure and the flow rate through a pressure probe set behind the casing. The flow rate may in turn be expressed in terms of the decompression characteristics of the fluid in the tool. Elimination of the flow rate allows one to obtain an explicit expression for the pressure decay in terms of permeability in the local region around the probe. Significant variation in the permeability estimates obtained at progressive depths of probe penetration within the cemented annulus could be interpreted as an indication of the cement permeability alteration. Although these procedures could be used to detect the changes in hydraulic isolation of the cement sheath, they do not provide any information on the presence and size of the isolation defects—a key input into the remedial action plan.

SUMMARY

Embodiments relate to apparatus and methods for evaluating wellbore integrity including introducing a drill to a surface of a casing encompassing an annulus, enclosing the drill in a housing hydraulically isolating the surface, drilling through the casing and into cement surrounding the casing, observing a pressure of the fluid within the housing and the annulus, and using the pressure observation and a drill position to evaluate a presence of a defect and a location of the defect. Embodiments also relate to apparatus and methods for evaluating wellbore integrity including a probe comprising a drill, wherein the probe is hydraulically isolated from the wellbore, a valve comprised in a housing that encompasses the drill, a pressure gauge to measure the pressure of the fluid within the housing, a pressure gauge to measure the pressure in the system outside the housing, and equipment to compare the pressure measurements and the position of the drill and to evaluate a presence and a location of the defect.

DETAILED DESCRIPTION

Motivated by the requirements outlined above, we disclose a tool and technique to detect and quantify the volume of hydraulically well-connected defects within the cemented annulus between the casing and the formation. The terms micro-annulus, crack, cavity are used interchangeably herein. The technique allows for multiple measurements at the same well depth and azimuth and is based on the interpretation of passive pressure measurement from single-probe cased-hole formation testing. Generally, some components of embodiments of this may benefit from concepts described in U.S. Pat. Nos. 7,753,117 and 7,753,118, which are both incorporated by reference herein in their entirety.

The technique disclosed herein allows for an almost real-time detection of the isolation defects and provides a method to estimate the volume of a connected region of cement cracks and micro-annuli. These are distinguished from a cement matrix by the large transmissibility of fluids within them, and thus enabling pressure equalization between the probe and the defect in a very short time scale in comparison to the characteristic time of a pretest.

The procedure entails the use of a cased-hole formation tester, which allows hydraulic communication with the cement through a probe placed coaxially with a drill assembly. In some embodiments, sudden changes in pressure during drilling are used to detect a micro-annulus. A special procedure is developed to estimate the volume of the micro-annulus supplemented by a profile of cement transmissibility as the probe is placed progressively deeper within the cement interior.

Figure 1:
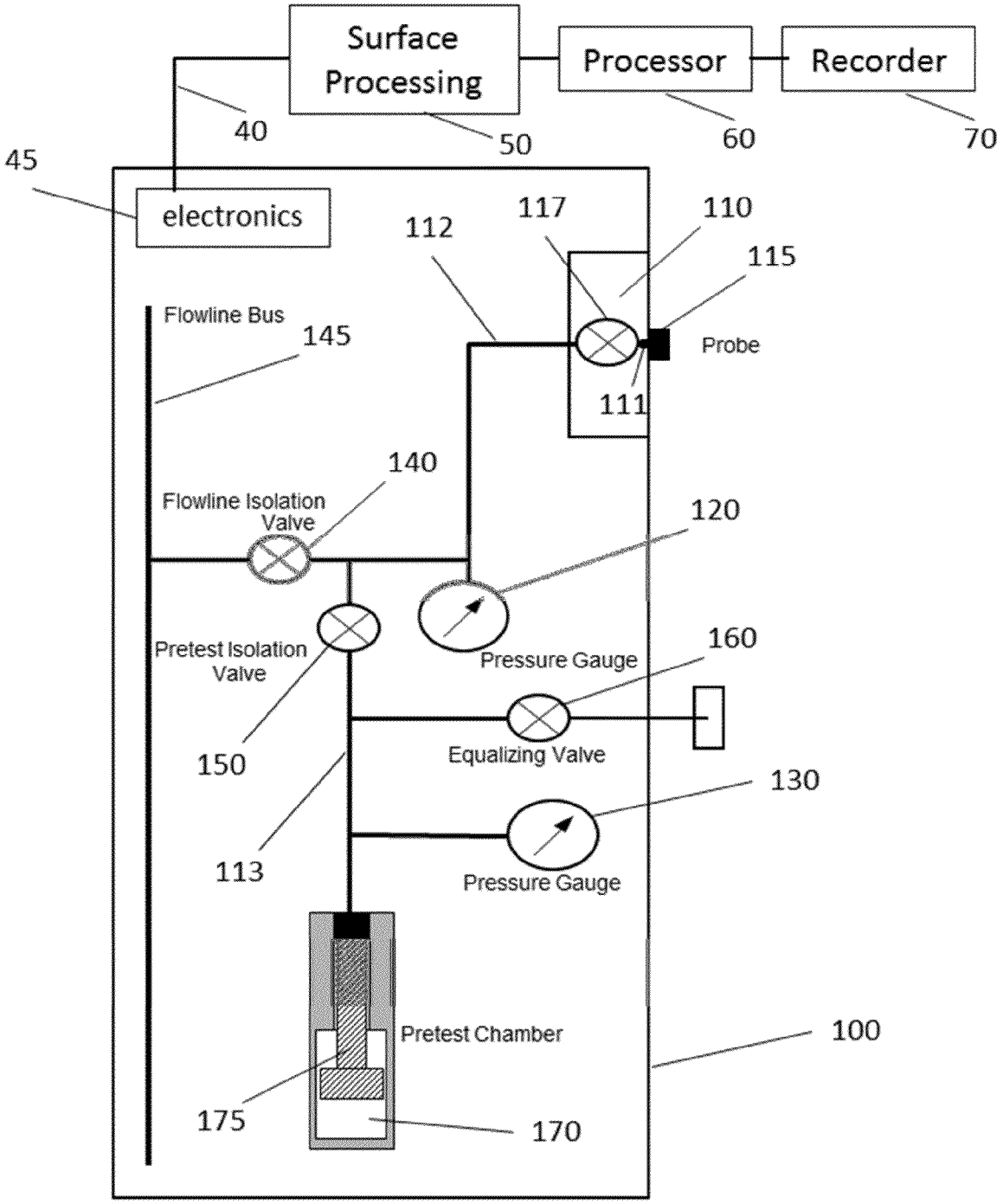
FIG. 1 is a schematic diagram of tool components.

The schematic of the tool 100 for micro-annulus detection and quantification is shown on FIG. 1. The tool design is based on the Cased Hole Dynamic Tester (CHDT™, commercially available from Schlumberger Technology Corporation of Sugar Land, Tex.) and is a modification thereof. The housing 110 contains a drill bit 111 that is able to drill through the casing into the cemented annulus through the probe 115 assembly. The probe is hydraulically isolated from the wellbore and provides direct hydraulic communication between the flowlines 112, 113 of the tool 100 and the cemented annulus through the probe isolation valve 117. The isolation valve 117 is shown in the figure but the tool may be operated without it.

The pressure in the tool flowlines 112, 113 is measured by pressure gauges 120 and 130. The flowline isolation valve 140 controls the flow into the flowline bus 145 for fluid analysis and fluid collection in the storage chambers (not shown). The pretest isolation valve 150 controls the connection of the flowline 113 with the pretest chamber 170. When equalizing valve 160 is open, the fluid in the tool flowlines 112, 113 is exposed to the wellbore pressure. There is a piston 175 in the pretest chamber that controls the drawdown and the pumpout of the fluid from the pretest chamber. Surface circuitry 50 represents control, communication, and preprocessing circuitry for the tool. This circuitry, some of which may be located downhole in the tool itself, may be of known type. A processor 60 and a recorder 70 may also be provided uphole. The circuitry 50, the processor 60, and the recorder 70 can communicate with the tool 100 via an armored multi-conductor cable 40. The testing procedures described below can be performed using a suitably programmed processor (such as a computer, microprocessor or a DSP). The tool 100 includes electronics 45 for at least one of storing, pre-processing, processing, and sending uphole to the surface circuitry 50 information related to pressure sensed by the pressure gauges 120 and 130. The electronics 45 may have additional functions including: receiving control signals from the surface circuitry 50 and for controlling the piston 175, controlling the drill 111, and controlling valves 117, 140, 150, and 160. It will be appreciated that any tool such as the Schlumberger CHDT™ which includes tool-setting pistons, a drill, a hydraulic line and electronics, can be modified, if necessary, with the appropriate sensors and can have its electronics programmed or modified to accomplish the functions of tool 100 as further described below.

Testing Procedure

In one embodiment, the testing procedure consists of five components:

- Detection of the isolation defect
- Evaluation of hydraulic isolation of the defect (connectivity to permeable formation)
- Quantification (volume evaluation) of the isolated defect
- Volume assignment for a gas-filled defect, if applicable
- Evaluation of transmissibility of the isolation defect across zones that need to be isolated from each other Detection of the Isolation Defect This section discusses the testing procedure to detect the presence of the defects in the cement. It is assumed that the tool 100 is positioned at the depth of interest and the probe 115 is set to hydraulically isolate the flowlines 112, 113 of the tool from the wellbore. The flowline isolation valve 140 and the equalizing valve 160 that allows communication to the borehole are initially in the CLOSED position.

As is common, it is assumed that the pressure in the cemented annulus is lower than the wellbore pressure. The methods disclosed here are also applicable when the situation is reversed, except that the terminology for pressure decline and increase would be reversed. By opening equalizing valve 160 and pretest isolation valve 150, the fluid in the tool pretest and the probe lines are exposed to the wellbore pressure. Once the pressure measured at the pressure gauges 120 and 130 reaches the wellbore pressure, the equalizing valve 160 is shut into the closed position. Thus, the measured pressure within the tool is the wellbore pressure.

In another embodiment, the equalizing valve 160 is open and the pretest chamber 170 is filled with wellbore fluid. With probe isolation valve 117 and equalizing valve 160 in closed position, the pressure in the tool flowlines 112, 113 can be increased to a desired value by decreasing the volume in the pretest chamber 170 by moving the piston 175 forward from a previously retracted position. Caution must be exercised that the pressure does not exceed the wellbore pressure significantly lest a seal between the wellbore and the probe may fail. Conversely, by having the pretest piston retracted by a small amount, the pressure may be decreased.

The disclosed defect identification procedure is based on the detecting sudden change in the pressure measured in the part of the tool flowline, which is in hydraulic communication with the probe. The decrease occurs upon fluid pressure communication of the probe with the defect. If the sudden decrease brings the measured tool pressure to the subsequently identified formation pressure, the cement is identified to be a failed one. Any intermediate value is indicative of an isolated defect. For the present purpose, an isolated defect communicates via robustly set cement, the latter exhibiting permeabilities of a few μD or below.

Figure 2:
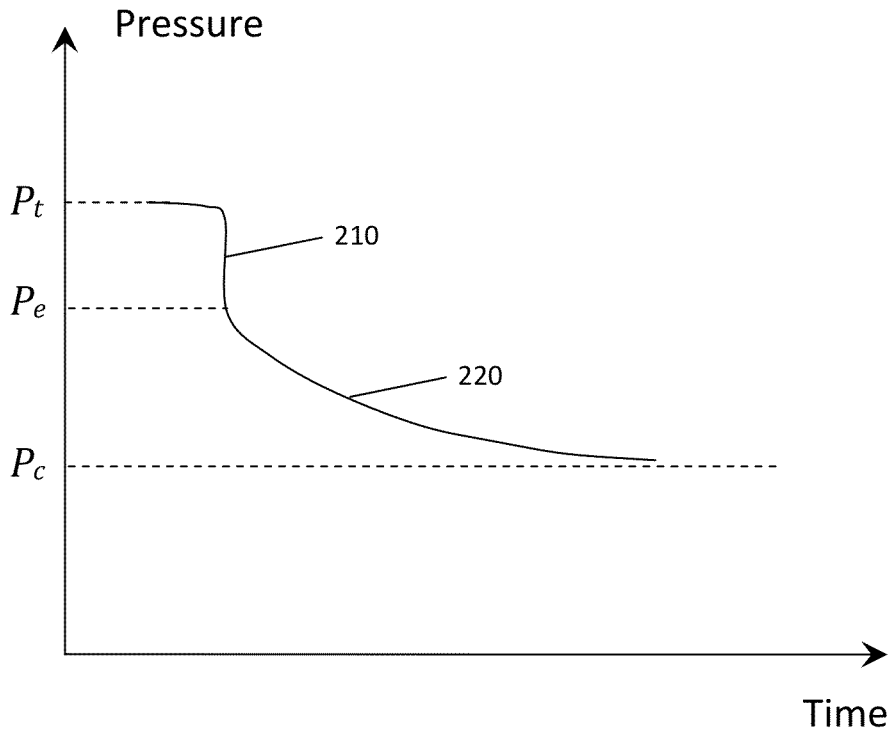
FIG. 2 is a chart of pressure as a function of time.

After the drill-bit penetrates through the casing into the cemented annulus, it may intersect the micro-annulus or a crack in the cement. Let $P_t$ be the initial pressure in the tool flowline, and $P_c$ the initial pressure in the cement before the start of the test. Once the defect is intersected by the drill-bit, the pressure in the flowline will immediately decrease to a value between $P_t$ and $P_c$ as illustrated on FIG. 2 (segment 210). The drop in the pressure occurs since the fluid in the tool flowlines becomes exposed to the fluid in the cement cavity initially at a lower pressure. Therefore, the pressure in the combined flowline and cavity volume will quickly equilibrate to a new pressure $P_e$. The subsequent decompression to the formation pressure because of the minor communication via the remaining cement is a relatively slow process, as illustrated in FIG. 2 (segment 220). The latter is controlled by the permeability of the cement around the drilled probe and the surface area of the intersected defect. The interpretation procedure (disclosed in U.S. Pat. No. 7,753,118, incorporated by reference herein in a previous application paragraph) with suitable modification can be then applied to estimate the magnitude of effective permeability of the cement. The modification requires consideration of the defect providing a large areal contact of uniform pressure. For this, the new total volume given by the flow-line and the detected defect should be used in the calculation along with an assumed geometry of the defect. The method to estimate the volume of the defect is disclosed in the next section.

If the obtained permeability estimate indicates uniform low permeability cement (about a few μD and below) around the defect, the detected anomaly is most likely not directly hydraulically connected to the highly permeable formation zone. Alternatively, if the pressure evolution quickly equilibrates at pressure $P_e$ different from $P_c$ and does not exhibit slow exponential decay, the detected defect is likely to be hydraulically well connected to another formation zone. To confirm this, a repeat detection test should be performed as described below to rule out the case of very tight cement around the probe and the detected defect.

To evaluate a strong communication of the defect to another zone, the probe isolation valve 117 is CLOSED after a first test. The pretest isolation valve 150 and equalizing valve 160 are OPEN to increase the pressure in the flowlines to $P_t$. It is preferable to open the flowline isolation valve 140 to have an increased volume within the tool. Subsequently, the equalizing valve 160 is put into CLOSE position and the probe isolation valve 117 is set to OPEN position. If the new equilibrated pressure $P_e$ is the same as it was after the first test, and the decline is to a pressure different from $P_c$, the detected defect provides hydraulic connection to a permeable formation zone and the measured $P_e$ is related to the formation pressure at that zone (corrected by hydrostatic gradient).

In a third procedure, the probe isolation valve 117 and pretest isolation valve 150 are set OPEN after the first test. The piston 175 is used to drawdown fluid from the detected defect into the pretest chamber 170. After the drawdown is complete, the pressure is monitored by pressure gauges 120 and 130. If the pressure quickly recovers to the same value $P_e$ as it was after the first detection test, the detected defect is hydraulically connected to a permeable formation zone. The same procedure could also be conducted by elevating the probe pressure by moving the pretest piston forward by a small amount so that the pressure elevation is limited.

The sensitivity of the defect detection technique is highly dependent on the volume of the fluid in the tool flowlines and the defect volume as will be obvious in the next subsection. Therefore, in one embodiment, the pretest isolation valve 150 is in the CLOSED position thus reducing the volume of the fluid inside the tool that will be exposed to the cement annulus during drilling.

In one method, during drilling, the probe isolation valve 117 is in open position. With a slow drill-bit progression into the cemented annulus, an estimate of the inner radial position of the isolated defect is possible.

In another method, valve 117 is closed during drilling. The drill-bit penetrates through the casing and stopped at a certain position within the cemented annulus. After the fluid inside the tool is pressurized, valve 117 is open and the defect detection procedure is performed as described above.

Quantification (Volume Evaluation) of the Isolation Defect

Even if the detected defect (e.g., micro-annulus, crack or cavity) is found not to communicate to a permeable formation zone, it is useful to know the volume of the defect. The volume estimate is a key input for the remedial action plan such as a squeeze of an isolating material. In this section, we disclose the testing procedure and the interpretation to estimate the volume of the detected defect. We first introduce the following notations:

$V_t$: volume of the flow-line in the tool in direct hydraulic communication with the probe $\rho_t$: density of the fluid inside the tool flowline in direct hydraulic communication with the probe $V_d$: volume of the detected defect in the cemented annulus $\rho_d$: density of the fluid occupying the detected defect in the cemented annulus, prior to drilling $\rho_e$: final density of the fluid in the combined tool and cavity system c: compressibility of the fluid, assumed same within the tool and the defect The mass of the fluid inside the tool before the start of the test is $\rho_t V_t$. Similarly, the mass of the fluid originally occupying the detected defect (micro-annulus) is $\rho_d V_d$. The total mass of the fluid in the tool and micro-annulus should be equal to the sum of the individual mass contributions (here we neglect a mass loss due to the flow through the cement since the pressure equilibration happens almost immediately). Therefore, mass conservation implies $$\rho_t V_t + \rho_d V_d = \rho_e (V_t + V_d). \tag{1}$$

Using the reference state of the fluid denoted by a subscript 0 for density ρ and pressure P, we can rewrite Eq. 1

$$V_t \rho_0 e^{c(P_t - P_0)} + V_d \rho_0 e^{c(P_c - P_0)} = (V_t + V_d) \rho_0 e^{c(P_e - P_0)}. \tag{2}$$

Therefore, $$V_t e^{cP_t} + V_d e^{cP_c} = (V_t + V_d) e^{cP_e}. \tag{3}$$

Solving Eq. 3 for $V_d$ leads to $$V_d = V_t \frac{e^{cP_t} - e^{cP_e}}{e^{cP_e} - e^{cP_e}}. \tag{4}$$

For typical values of compressibility ($10^{-10}$ $Pa^{-1}$) and pressures ($10^7$ Pa), we can use first-order Taylor expansion for the exponentials in Eq. 4, which after simplification gives the final expression $$V_d \approx V_t \frac{P_t - P_e}{P_e - P_c}. \tag{5}$$

Eq. 5 shows that the sensitivity of the detection technique (i.e., the ability to detect small volume defects) depends on the volume of the tool flowlines in direct hydraulic communication with the probe, and the error associated with the measurement of pressures and $V_t$. For maximal sensitivity, one would prefer a tool volume comparable to the size of the defect. Therefore, if the small size defects are of interest, the pretest isolation valve 150 should be CLOSED during the testing procedure to minimize the $V_t$. Conversely, if a large volume defect is anticipated, then either the pretest chamber may be kept in a fully retracted position, by moving piston 175, or further yet the isolation valve 140 opened to communicate to the flowline bus. Ultrasonic logs are useful in estimating the areal coverage of the defect. This is explained further below.

We will also consider the case when the compressibilities of the two fluids are substantially different. This occurs when the detected defect is filled with gas. We consider the case where the fluid occupying the defect and the flowline/cement pore fluid are immiscible. In one embodiment, since $P_t > P_c$, once the drill-bit penetrates into the defect, with the probe isolation valve 117 OPEN, there will be an increase in volume for the fluid in the tool flowlines and the decrease in volume for the fluid occupying the defect.

Let ΔV denote a change in volume in the fluid within the tool. A corresponding decrease occurs in the fluid within the defect. We start with the conservation of mass for each fluid individually.

$$\rho_t V_t = \rho_{te}(V_t + \Delta V) \tag{6}$$

and $$\rho_d V_d = \rho_{de}(V_d - \Delta V), \tag{7}$$

where $\rho_{te}$ and $\rho_{de}$ are density of the original fluid inside the tool flowline and the original fluid occupying the defect respectively under the equilibrated pressure $P_e$. We can solve Eq. 6 so that $$\Delta V = V_t\left(\frac{\rho_t}{\rho_{te}} - 1\right) = V_t\left(\frac{\rho_0 e^{c_t(P_t - P_0)}}{\rho_0 e^{c_t(P_{te} - P_0)}} - 1\right). \tag{8}$$

Using first-order Taylor expansion the above equation simplifies to $$\Delta V \approx V_t c_t (P_t - P_e). \tag{9}$$

Solving Eq. 7 for $V_d$ we obtain $$V_d = \Delta V \frac{\rho_{de}}{\rho_{de} - \rho_d} = \frac{\Delta V}{1 - \rho_d / \rho_{de}}. \quad (10)$$

The ratio $\rho_d/\rho_{de}$ can be expressed via compressibility and the density $\rho_0$ at the reference state with pressure $P_0$:

$$\frac{\rho_d}{\rho_{de}} = \frac{\rho_0 e^{c_d(P_c - P_0)}}{\rho_0 e^{c_d(P_e - P_0)}} = e^{c_d(P_c - P_e)}. \quad (11)$$

Here we have assumed that within the pressure range of interest, an average value of $c_d$ may be used. For large ranges of pressure, one has to use an average value for compressibility relevant to the pressure difference of interest. Substituting Eq. 11 and Eq. 9 into Eq. 10 we obtain $$V_d = V_t \frac{c_t(P_t - P_e)}{1 - e^{c_d(P_c - P_e)}}. \quad (12)$$

Note that when $c_t = c_d$, Eq. 12 reduces to Eq. 5. Typical values of compressibility for gases (e.g., methane) are 100 to 1000 higher than compressibility of the liquids (e.g., water) under reservoir pressure and temperature. If the isolation defect is originally filled with gas, the final pressure is close to $P_c$. Then, for a fixed resolution in pressure, the ability to discern the size of the defect diminishes.

Advantageously, a repeat test can be performed to obtain a second estimate of $V_d$. In one embodiment, the probe isolation valve 117 is closed and the fluid in the flowlines is pressurized as described above. Once the desired pressure $P_t$ is reached in the tool flowlines, the valve 117 is opened and the new equilibrated pressure $P_e$ is observed. The volume of the defect is calculated using Eq. 5 or Eq. 12 (depending on the fluid occupying the detected defect) with appropriate values of $P_t$, $P_e$, and $P_c$.

In another embodiment, the valve 117 is opened before the repeat test is performed. With pretest isolation valve 150 closed, the fluid in the flowlines connecting valve 150 to the pretest chamber and the equalizing valve 160 is pressurized to a desired pressure $P_t$. Once the valve 150 is open, the new equilibrated pressure $P_e$ is observed. The volume of the detected defect is then calculated using Eq. 5 or Eq. 12 (depending on the fluid occupying the detected defect) with appropriate values of $P_t$, $P_e$, and $P_c$. Note that $V_t$ in this case will include only the volume of flowlines below valve 150 (see FIG. 1). To obtain the volume of the detected defect, calculated $V_d$ should be corrected for the volume of tool flowlines connecting valve 150 to the probe.

Procedure for a Gas-Filled Defect

For a gas-filled defect, for a change in pressure indicative of $V_d$, we need $V_t c_t \approx V_d c_d$. Given that the $c_d/c_t$ ratio is about 100-1000, $V_t$ has to be at least about $100V_d$. However, this is not known a priori.

When $V_t c_t \ll V_d c_d$, $P_c$ will drop close to $P_c$, the initial fluid pressure within the cement. A slow transient follows this drop. Such an observation has two possibilities: (i) gas fills the defect or (ii) a perfect communication is present from the defect to the formation. A repeat experiment with a larger volume of $V_t$, as discussed previously will allow us to judge which of the options is likely.

In one embodiment, the repeat experiment entails shutting valve 117 and opening equalizing valve 160, opening flow line valve 140, allowing the pressure to move back to $P_t$, shutting valve 160, and opening valve 117. If the gas composition is known from circumstantial information, a cross-check may be carried out. Since $c_d$ will be known for downhole conditions, knowing $V_t$ allows us to determine $V_d$ via Eq. 12 twice with two different values of $V_t$.

Additionally, if further penetration of the probe shows that the transient to $P_c$ is rapid, the drop in pressure is due to perfect communication between the defect and the formation.

Testing Procedure

Figure 3:
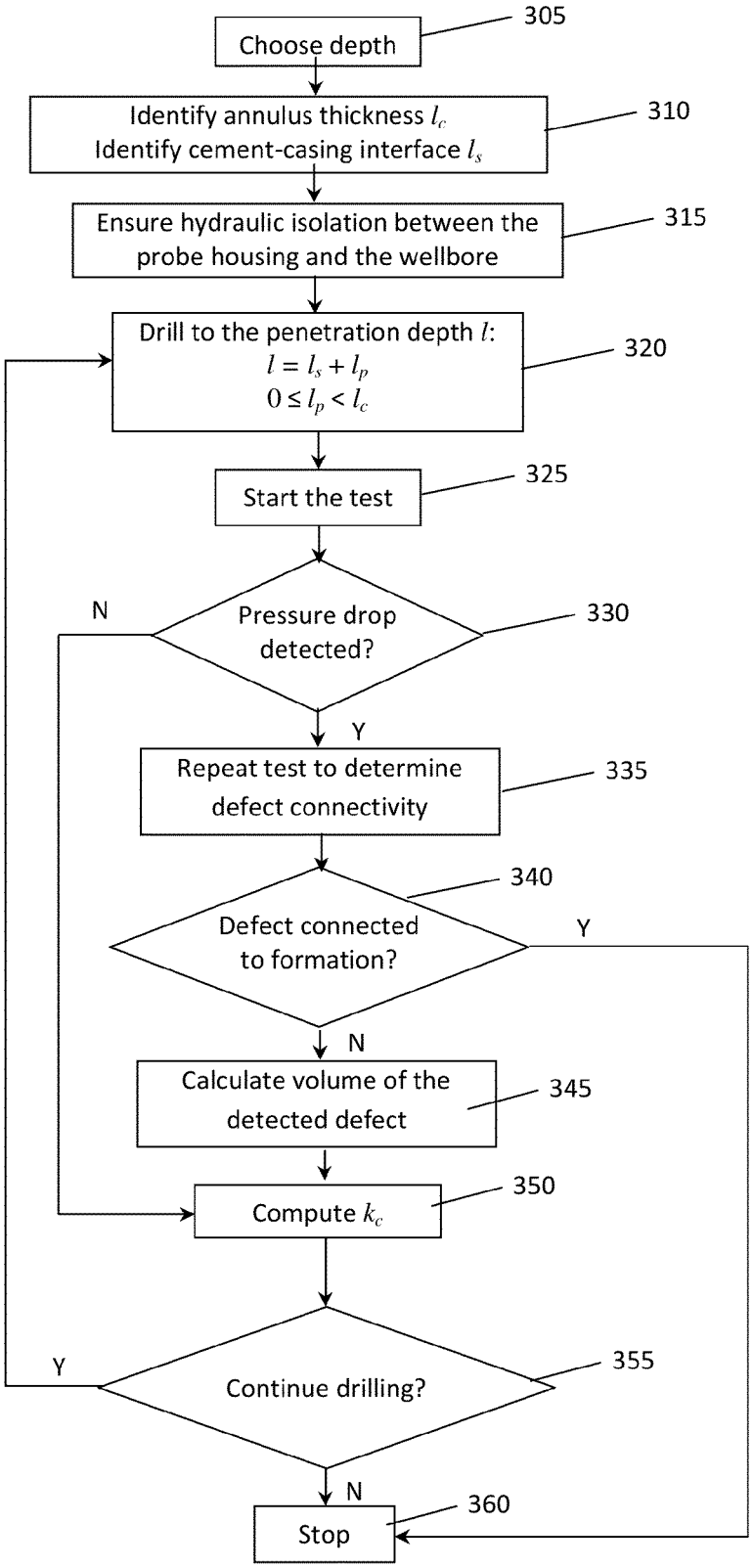
FIG. 3 is a flow chart of a testing procedure.

In one embodiment, the testing procedure includes the following steps to evaluate cement integrity (see FIG. 3):

- The depth of the test is selected (e.g., based on the acoustic/ultrasonic measurements such as cement bond log) at Step 305.
- Cement thickness and casing thickness are identified at Step 310 based on well completion specifications and other available information such as third interface echoes from ultrasonic measurements.
- The seal around the housing with the probe is set and tested for hydraulic isolation at Step 315.
- The drill bit penetrates through the casing to a desired depth of penetration into the cemented annulus at Step 320.
- With the hydraulically isolated probe set at Step 325, the fluid in the tool flowlines is pressurized to pressure $P_t > P_c$ either by opening equalizing valve 160 or by raising the pressure in the pretest chamber 170 by moving the piston 175.
- If the pressure drop from $P_t$ to $P_e$ is observed at Step 330, the drill-bit intersected the defect in the cemented annulus. The position of the drill bit at the time of the pressure drop will indicate the position of the isolation defect. If no pressure drop is observed, proceed to Step 350 to estimate cement permeability following procedures disclosed in U.S. Pat. No. 7,753,118.
- Repeat the pressure test as described in embodiments above to determining if the detected defect is directly connected to a permeable formation zone (Step 335).
- If the detected defect is proved to be not connected to a formation at Step 340, proceed to Step 345 and use the data from the two pressure tests (Steps 325 and 335) to estimate the volume of the detected defect using Eq. 5 or Eq. 12 (depending on the fluids filling the defect and the tool flowline). Repeat the test to obtain additional estimate of the volume, if necessary.
- Proceed to Step 350 to evaluate the permeability of the cement around the probe and the detected isolation defect by using interpretation technique as described in U.S. Pat. No. 7,753,118, but suitably corrected by accounting for the presence of the defect. Specifically, the boundary value problem has to be solved with a penetrating probe intersecting a slit, and thus a third parameter ($L/r_p$) is necessary, the other two being $L_p/r_p$, and $L_c/r_p$, where $L_p$ is the penetration distance of the probe into the cement, and $L_c$ is the cement thickness. A geometrical assumption with regard to the shape of the defect from sonic logs and the volume of the defect is needed. An example of this is shown below and is illustrated in FIG. 4.
- If the detected defect is proved to be connected to a permeable formation zone at Step 340, zonal isolation at the depth of test is compromised. Proceed to Step 360 and start remedial action planning.

Transmissibility Estimate

Remedial action to restore cement integrity might include squeezing sealing material into the detected defect. The transmissibility of the defect is an important property to evaluate before the remedial job is performed. The transmissibility of the defect is a measure of the defect's ability to facilitate longitudinal flow, meaning flow along the annulus or a gap caused by the defect. As a practical matter, if the defect is directly connected to the permeable formation zone no effective estimate of its volume using the disclosed procedure is available. The effective transmissibility of the micro-annulus that is not directly connected to the formation zone may be estimated as follows.

Figures 4A, 4B:
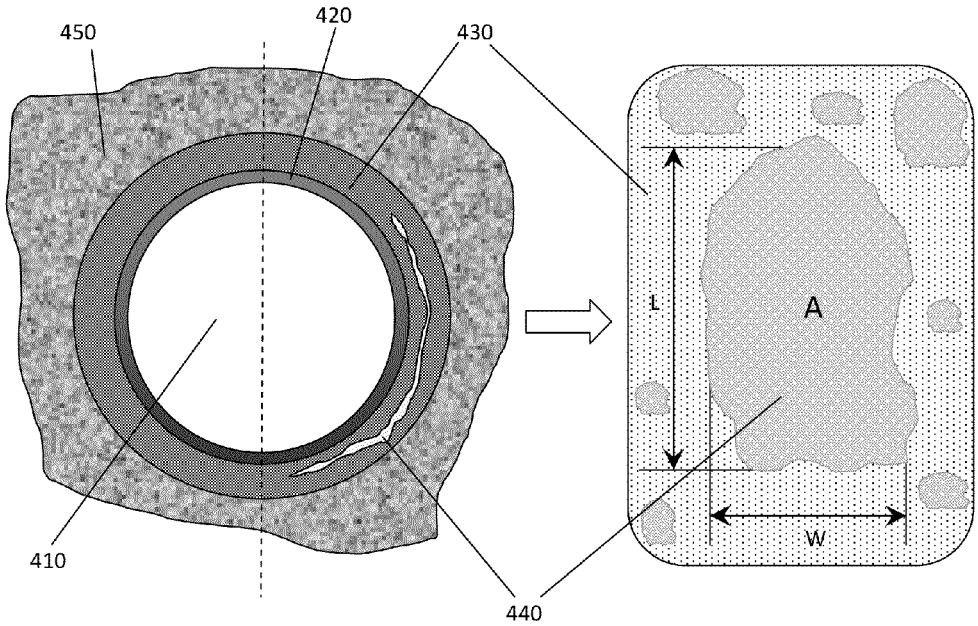
FIGS. 4A and 4B are schematic diagrams of (a) geometry of the defect—top view and (b) illustration of the corresponding ultrasonic image—side view.

FIG. 4*a* shows a schematic representation of the cross-sectional (top) view of the wellbore-casing-annulus system. Casing 420 isolates wellbore 410 from formation 450. The annulus between casing 420 and formation 450 is filled with cement 430. The micro-annulus 440 and other isolation defects might be present in the cement annulus 430.

Let us, for example, consider a patch of area A (see FIG. 4*b*) where a micro-annulus 440 is detected next to the casing 420. If the micro-annulus 440 is thin enough, since the area is on a cylindrical surface, the width of the gap is $$b = \frac{V_d}{A}. \tag{13}$$

Let the length of the defect along the borehole be L (as shown in FIG. 4*b*). The average width of the defect is $$W = A/L. \tag{14}$$

By solving standard Stokes flow in this slit, and assuming a uniform average width W, we have the following expression for flow rate through the isolation defect when a pressure difference of ΔP exists across L $$Q = \frac{2}{3\mu}\frac{\Delta P}{L}\frac{b^3}{8}W, \tag{15}$$

where μ is the shear coefficient of viscosity. Thus, fluid loss through the defect in a co-mingled system may be calculated.

Based on the cement ultrasonic logs, it may be desirable to know the extent of hydraulic isolation, or more appropriately lack of it. In many instances such a test is desirable before the casing is perforated. Once perforated, a defect may connect two separate zones. For such cases, the above expression is useful to know the extent of potential communication. If upon estimate of the volume, it is suggested that the width W is small, hydraulic communication may be sufficiently small that a remedy may not be necessary. Additionally, two separate tests revealing quite different defect volumes when set at two different positions also indicate that the defect seen on a ultrasonic tool comprises separate defects that appear overlapping. The images obtained by sonic or ultrasonic tools contain various levels of processing that may introduce occasional artifacts not resolvable in the absence of additional data. Thus, in the context of FIG. 4*a* and FIG. 4*b*, what appears as an indication of a single defect in an ultrasonic log is resolved to be fully connected of not through the above disclosed procedure for volume estimation.

For estimating the cement permeability around the probe and the detected defect the boundary value problem has to be solved with a penetrating probe intersecting a slit. In order to account for a complex geometry of a probe-defect-annulus system a third parameter ($L/r_p$) is necessary, the other two being $L_p/r_p$, and $L/r_p$, where $L_p$ is the penetration distance of the probe into the cement, and $L_c$ is the cement thickness. Relationships for the correction factor as illustrated in the prior patents (U.S. Pat. No. 7,753,118) are necessary.

In another embodiment, one can measure the transmissibility of the detected defect directly by squeezing in the fluid with known PVT properties from the pretest chamber and measuring the change in pressure with gauges 120 and 130, and inferring the flow rate via change in the position of the piston 175 inside the pretest chamber 170. Advantageously, this method can be also applied in the case when the detected defect is found to be in direct hydraulic communication with permeable formation zone.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A method for evaluating wellbore integrity, comprising:

(a) introducing a tool into a wellbore, wherein the tool comprises a probe, a drill, and at least one flowline;

(b) hydraulically isolating a surface of a casing using the probe;

(c) using the drill to drill through the surface of the casing and into a cemented annulus surrounding the casing to establish communication between fluid within the cemented annulus and fluid within the at least one flowline;

(d) observing pressure of the fluid within the at least one flowline;

(e) identifying a pressure change within the fluid within the at least one flowline; and (f) using the pressures change and drill position to identify a presence of a defect within the cemented annulus and a location of the defect.

2. The method of claim 1, further comprising:

determining whether the defect is directly connected to a permeable formation zone.

3. The method of claim 1, further comprising:

determining whether the defect is filled with a gas or a liquid.

4. The method of claim 1, wherein observing pressure of the fluid within the flowline comprises observing pressure differences over time.

5. The method of claim 1, further comprising:

calculating a volume of the defect in the cemented annulus.

6. The method of claim 1, further comprising:

determining transmissibility of the defect using information from an acoustic log, wherein the defect is not connected to a permeable formation zone.

7. The method of claim 1, further comprising:

repeating processes (a) to (f) at an adjacent location for evaluating connectivity of the defect to the adjacent location.

8. The method of claim 1, further comprising:

measuring transmissibility of the defect, wherein the defect is hydraulically connected to a permeable zone.

9. The method of claim 1, wherein the pressure change is a sudden pressure drop.

10. The method of claim 9, wherein the identifying a pressure change within the fluid within the at least one flowline comprises identifying the sudden pressure drop and identifying a slow pressure decay.

11. The method of claim 9, further comprising:

controlling hydraulic communication between the at least one flowline and the probe using a valve.

12. The method of claim 11, wherein the valve is open after drilling.

13. The method of claim 11, wherein the valve is closed during drilling.

14. The method of claim 9, further comprising:

adjusting volume of the at least one flowline.

15. The method of claim 9, further comprising:

adjusting pressure inside the at least one flowline.

16. A system for evaluating wellbore integrity, comprising:

a probe configured to provide hydraulic isolation between a portion of casing and the wellbore;

a drill configured to drill through the casing and into a cemented annulus;

at least one flowline configured to be filled with a fluid;

a valve configured to control hydraulic communication between the at least one flowline and the probe;

a pressure gauge to measure pressure of the fluid within the at least one flowline; and a processor configured to (i) identify a pressure change within the at least one flowline and (ii) identify a presence of a defect within the cemented annulus and a location of the defect using the pressure change and drill position.

17. The system of claim 16, further comprising a pre-test chamber.

18. The system of claim 17, further comprising:

a second valve between the pre-test chamber and the probe, wherein the at least one flowline comprises (i) a first flowline between the probe and the second valve and (ii) a second flowline between the second valve and the pre-test chamber.

19. The system of claim 18, further comprising:

a second pressure gauge configured to measure pressure of fluid in the second flowline.

20. The system of claim 17, wherein volume of the at least one flowline is adjusted using the pre-test chamber.

21. The system of claim 16, further comprising an equalizing valve.

22. The system of claim 16, wherein the processor is further configured to determine whether the defect is directly connected to a permeable formation zone.

23. The system of claim 16, wherein the processor is further configured to determine whether the defect is filled with a gas or a liquid.

24. The system of claim 16, wherein pressure within the at least one flowline is adjusted.

25. The system of claim 16, wherein the pressure change is sudden pressure drop.

26. The system of claim 25, wherein the processor is further configured to identify the sudden pressure drop and slow pressure decay.

* * * * *